US007464658B2

(12) United States Patent
Dhellemmes et al.

(10) Patent No.: US 7,464,658 B2
(45) Date of Patent: Dec. 16, 2008

(54) SEALED, THERMALLY INSULATED TANK INCORPORATED INTO THE LOAD-BEARING STRUCTURE OF A SHIP

(75) Inventors: Jacques Dhellemmes, Versailles (FR); Pierre Michalski, Le Havre (FR); Vincent Fargant, Rochefort en Yvelines (FR)

(73) Assignee: Gaztransport et Technigaz, Saint-Remy-les-Chevreuse (FR)

( * ) Notice: Subject to any disclaimer, the term of this patent is extended or adjusted under 35 U.S.C. 154(b) by 657 days.

(21) Appl. No.: 11/265,118

(22) Filed: Nov. 3, 2005

(65) Prior Publication Data

US 2006/0096185 A1 May 11, 2006

(30) Foreign Application Priority Data

Nov. 10, 2004 (FR) ..... 04 11967

(51) Int. Cl.
*B63B 25/08* (2006.01)

(52) U.S. Cl. ..... 114/74 A; 220/901

(58) Field of Classification Search ..... 114/74 A, 114/74 R, 74 T; 220/560.04, 560.06, 560.07, 220/560.12, 560.15, 901, 902
See application file for complete search history.

(56) References Cited

U.S. PATENT DOCUMENTS 3,719,302 A 3/1973 Hamilton
3,785,320 A * 1/1974 Bourgeois et al. ..... 114/74 A
3,982,653 A 9/1976 Becker
5,269,247 A * 12/1993 Jean ..... 114/74 A
5,586,513 A * 12/1996 Jean et al. ..... 114/74 A
6,035,795 A * 3/2000 Dhellemmes et al. ..... 114/74 A
6,145,690 A * 11/2000 Dhellemmes et al. .. 220/560.07
6,199,497 B1 * 3/2001 Dhellemmes et al. ..... 114/74 A
6,374,761 B1 * 4/2002 Dhellemmes ..... 114/74 A

FOREIGN PATENT DOCUMENTS

AU 23732 77 A 10/1978
FR 2798902 A 3/2001
GB 965502 7/1964

* cited by examiner

*Primary Examiner*—Lars A Olson
(74) *Attorney, Agent, or Firm*—Young & Thompson

(57) ABSTRACT

A sealed, thermally insulated tank consists of tank walls fixed to the load-bearing structure of a ship, the tank walls having, in succession, in the direction of the thickness from the inside to the outside of the tank, a primary sealing barrier, a primary insulating barrier, a secondary sealing barrier and a secondary insulating barrier, at least one of the insulating barriers consisting essentially of juxtaposed non-conducting elements (3), each non-conducting element including a thermal insulation liner, at least one panel and load-bearing partitions rising through the thickness of the thermal insulation liner in order to take up the compression forces. These partitions include at least one anti-buckle partition (14) that includes a plurality of anti-buckle wall elements that have a respective orientation forming an angle relative to a general longitudinal direction of the anti-buckle partition, for example forming corrugations or double-wall portions.

23 Claims, 7 Drawing Sheets

V
V
VI
VIII
VIII
13
14
16
17
18
19
20
21
23
24
25
26
27
65
113
116

SEALED, THERMALLY INSULATED TANK INCORPORATED INTO THE LOAD-BEARING STRUCTURE OF A SHIP

The present invention relates to the production of sealed, thermally insulated tanks consisting of tank walls fixed to the load-bearing structure of a floating structure suitable for the production, storage, loading, ocean carriage and/or unloading of cold liquids such as liquefied gases, particularly those with a high methane content. The present invention also relates to a methane carrier provided with a tank of this type.

Ocean carriage of liquefied gas at very low temperature involves an evaporation rate per day's sailing that it would be advantageous to minimize, which means that the thermal insulation of the relevant tanks should be improved.

A sealed, thermally insulated tank consisting of tank walls fixed to the load-bearing structure of a ship has already been proposed, said tank walls having, in succession, in the direction of the thickness from the inside to the outside of said tank, a primary sealing barrier, a primary insulating barrier, a secondary sealing barrier and a secondary insulating barrier, at least one of said insulating barriers consisting essentially of juxtaposed non-conducting elements, each non-conducting element including a thermal insulation liner arranged in the form of a layer parallel to said tank wall, at least one panel extending parallel to said tank wall over at least one side of said thermal insulation liner and load-bearing partitions projecting from a face of said at least one panel facing said thermal insulation liner, said load-bearing partitions rising through the thickness of said thermal insulation liner in order to take up the compression forces.

For example, in FR-A-2 527 544 these insulating barriers consist of closed parallelepipedal caissons made from plywood and filled with perlite. On the inside, the caisson includes parallel load-bearing spacers interposed between a cover panel and a base panel in order to withstand the hydrostatic pressure exerted by the liquid contained in the tank. Non-load-bearing spacers made from plastic foam are placed between the load-bearing spacers in order to maintain their relative positioning. Manufacture of a caisson of this type, including the assembly of the outer walls made from plywood sections and the fitting of the spacers, requires a number of assembly operations, particularly stapling. Furthermore, the use of a powder such as perlite complicates the manufacture of the caissons because the powder produces dust. Thus, it is necessary to use high-quality and therefore expensive plywood so that the caisson is well sealed against dust, i.e. knot-free plywood. Furthermore, it is necessary to tamp down the powder with a specific pressure in the caisson, and it is necessary to circulate nitrogen inside each caisson in order to evacuate all the air present, for safety reasons. All these operations complicate manufacture and increase the cost of the caissons.

Moreover, if the thickness of the insulating caissons is increased with an insulating barrier, the risk of the walls of the caissons and the load-bearing spacers buckling increases considerably. If it is desired to increase the anti-buckling strength of the caissons and of their internal load-bearing spacers, the cross section of said spacers has to be increased, which increases the thermal bridges established between the liquefied gas and the load-bearing structure of the ship by the same amount. Furthermore, if the thickness of the caissons is increased it is observed that, inside the caissons, gas convection currents arise that are highly detrimental to good thermal insulation.

FR-A-2 798 902 describes other thermally insulated caissons designed for use in such a tank. Their method of manufacture consists in alternately stacking a plurality of low-density foam layers and a plurality of plywood panels, placing adhesive between each foam layer and each panel until the height of said stack corresponds to the length of said caissons, in cutting the above-mentioned stack into sections in the direction of the height, at regular intervals corresponding to the thickness of a caisson, and in adhesively bonding a base panel and a top panel made from plywood on either side of each stack section thus cut, said panels extending perpendicularly to said cut panels, which serve as spacers. Although the result of this is a good compromise in terms of anti-buckling strength and thermal insulation, it has to be admitted that this manufacturing process also requires numerous assembly stages. Furthermore, procurement of good-quality plywood could become problematic in the future.

An object of the invention is to propose a tank of this type while also improving at least one of the following characteristics without detriment to others of these characteristics: the tank's cost price, the ability of the walls to withstand pressure and the thermal insulation of the walls.

To that end, a subject of the invention is a sealed, thermally insulated tank including at least one tank wall fixed to the load-bearing structure of a floating structure, said tank wall having, in succession, in the direction of the thickness from the inside to the outside of said tank, a primary sealing barrier, a primary insulating barrier, a secondary sealing barrier and a secondary insulating barrier, at least one of said insulating barriers consisting essentially of juxtaposed non-conducting elements. Each non-conducting element includes a thermal insulation liner arranged in the form of a layer parallel to said tank wall, at least one panel extending parallel to said tank wall over at least one side of said thermal insulation liner and load-bearing partitions projecting from a face of said at least one panel facing said thermal insulation liner, said load-bearing partitions rising through the thickness of said thermal insulation liner in order to take up the compression forces. This tank is characterized in that said load-bearing partitions include at least one anti-buckle partition that, seen in cross section in a plane parallel to said at least one panel, has a general longitudinal direction and includes a plurality of anti-buckle wall elements that have a respective orientation forming an angle relative to said general longitudinal direction of the anti-buckle partition.

The basic idea here is to create one or more partitions, called anti-buckle partitions, having a respective general longitudinal direction and including wall elements, called anti-buckle wall elements, that are not oriented parallel to this general direction so as to increase the partition's moment of inertia in the transverse direction of the partition. Thus, even produced with a thin wall, the partition has good resistance to the compression forces in the direction perpendicular to the base and/or cover panel(s). It is thus possible to obtain a spacing partition that combines different qualities in terms of mechanical strength, economy of materials, light weight and effective cross section for the conduction of heat.

An anti-buckle partition of this type may have various structures. Preferably, an anti-buckle partition of this type has a substantially continuous wall extending in the general longitudinal direction. This may be a single wall or an unlined wall with a transverse gap or, alternately, a wall in which certain portions are single and others unlined. It is also possible for the anti-buckle partition to have, at least locally, more than two walls spaced apart in the transverse direction.

According to a particular embodiment, suitable, in particular, for a single-wall anti-buckle partition—although not exclusively—the anti-buckle partition includes a wall, called anti-buckle wall, that includes anti-buckle wall elements linked together directly or indirectly and that, seen in cross section in a plane parallel to said base and/or cover panel(s), extends in said general longitudinal direction of said anti-buckle partition with a profile deviating laterally on either side of a longitudinal median line of said anti-buckle partition. In this embodiment, the anti-buckle wall elements form an integral part of the anti-buckle wall. They are connected as a single piece, either directly or by means of other portions of the anti-buckle wall, i.e. by somewhat longitudinal portions.

The profile of the anti-buckle wall thus formed may have a regular form, i.e. devoid of angles, for example a form with alternate half-circles or a substantially sinusoidal wave. In such a case, the anti-buckle wall may have an orientation that varies continuously.

Alternately, or in combination, the profile of the anti-buckle wall may also have, at least locally, an angular form. For example, anti-buckle wall elements may be connected directly together, forming mutual angles in the manner of triangular teeth or of a more complicated polygonal line. Somewhat longitudinal wall elements may also be intercalated, at least locally, with anti-buckle wall elements, for example in order to form a profile in the form of rectangular or trapezoidal crenelations. Other profile forms are also possible, for example by alternating different motifs and by using straight or curved anti-buckle wall elements.

According to a further particular embodiment, suitable, in particular, for a single-wall or multiple-wall anti-buckle partition, said anti-buckle partition includes at least one wall extending in said general longitudinal direction to which anti-buckle wall elements projecting from said wall are linked. In such a case, the anti-buckle wall elements act as buttresses of a wall in order to increase the latter's moment of inertia in the transverse direction and thus to increase its resistance to compression and buckling forces. This is, for example, a straight planar wall or an anti-buckle wall of the above-mentioned type. The wall elements acting as buttress may have all kinds of forms in cross section in a plane parallel to the panel, for example a straight form, an open or closed curved form, an open or closed polygonal form, etc.

In the above embodiments, it is possible to make provision for anti-buckle wall elements to be arranged in such a manner as to longitudinally delimit a plurality of successive cells that, seen in a plane parallel to said at least one panel, have an open cross section.

According to a particular embodiment, said anti-buckle partition includes a second wall extending in said general longitudinal direction and spaced apart from the first wall in the transverse direction of the partition, said two walls being connected by a plurality of anti-buckle wall elements arranged between them. Such anti-buckle wall elements may be planar or curved. There may be any angle, for example a right angle, between the anti-buckle wall elements and each of the two walls.

According to a particular embodiment, said anti-buckle partition includes double-wall longitudinal portions that include, on each occasion, two laterally spaced wall elements and, in the region of the longitudinal ends of said portion, anti-buckle wall elements connecting said laterally spaced wall elements.

Seen in a plane parallel to the panel(s) of the non-conducting element, the double-wall portions thus formed may have any cross section—polygonal, rectangular, circular, ellipsoidal or the like, open or closed. The double-wall portions thus formed may be arranged adjacent to one another or spaced apart in the general longitudinal direction, the anti-buckle partition including single-wall longitudinal portions inserted between double-wall longitudinal portions.

For example, the anti-buckle wall elements and the laterally spaced wall portions may be connected, forming an angle. Alternately, the anti-buckle wall elements and the laterally spaced wall portions may be connected as a single piece in order to form a wall whose orientation varies continuously so as to enclose a cell of rounded cross section. However, when cells are formed in the anti-buckle partition, at least one ventilation hole is always left in order to avoid trapping air that might form an explosive mixture with the cargo in the event of an incident.

Preferably, apart from in the region of its ends, said anti-buckle partition has a periodic structure in the general longitudinal direction. A structure of this type guarantees good uniformity of the resistance to compression. Conversely, the structure of the anti-buckle partition may also be non-periodic, for example with a view to meeting certain localized mechanical requirements.

An anti-buckle partition may have a height direction substantially perpendicular to said base and/or cover panel(s), which is an optimum arrangement for taking up the compression forces, or, otherwise, be inclined relative to the said panels, which is an appropriate arrangement to counter shear and overturning forces received by the non-conducting element. In this regard, provision may be made for two anti-buckle partitions having opposite inclinations.

An anti-buckle partition and a base or cover panel may be assembled together by any means, such as adhesive bonding, welding, stapling, flush-fitting, etc., and combinations thereof. According to a particular embodiment, said or each anti-buckle partition is flush fitted in at least one base and/or cover panel of the non-conducting element. A method of assembly of this type is particularly robust, for example against the forces of shear and overturning.

According to a particular embodiment, said or each anti-buckle partition includes at least one load-distribution sole plate in the region of an edge of said anti-buckle partition facing a base or cover panel of the non-conducting element, said load-distribution sole plate extending in the direction of the length of said anti-buckle partition and having a planar surface fixed against said panel. For example, the load-distribution sole plate has a width greater than or equal to the lateral extent of the anti-buckle wall elements of the anti-buckle partition. This load-distribution sole plate, which may be provided on a side or on the two edges of the anti-buckle partition, stiffens the latter and prevents a concentration of stresses in a particular zone of the anti-buckle partition, which prevents localized pinching of the panel and offers a larger surface area for the link between the partition and the panel.

Alternately, or in combination, the anti-buckle partition may include at least one load-distribution sole plate in the region of an edge of said or each anti-buckle partition opposite said panel of the non-conducting element, said load-distribution sole plate extending in the direction of the length of said anti-buckle partition and having a planar surface bearing against the adjacent sealing barrier. In this embodiment, a face of the non-conducting element parallel to the tank wall is formed by a base or cover panel and its opposite face has no panel. Planar sole plates extending along the edge of the anti-buckle partitions opposite the panel fulfill the function of supporting a sealing barrier when they face toward the inside of the tank, or, when they face toward the load-bearing structure, the function of transmitting the pressure force of the non-conducting element onto the underlying sealing barrier.

An anti-buckle partition may be produced from any material that can be formed by molding, blow-molding, injection-molding, rotational molding, thermoforming, extrusion or pultrusion, particularly plastics and composite materials having at least two heterogeneous constituents. For example, the anti-buckle partitions may be produced from a polyester-resin-based composite, for example polyester resin or another resin. Within the meaning of the invention, the polymer-resin-based composite materials include polymers or mixtures of polymers with all kinds of fillers, additives, reinforcements or fibers, for example glass fibers or other fibers, providing sufficient rupture strength and rigidity and other properties. Additives may be employed to reduce the material's density and/or improve its thermal properties, particularly reducing its thermal conductivity and/or its expansion coefficient.

Such anti-buckle partitions made from plastic or a composite combine very advantageous properties in terms of mechanics, of ease of forming, of thermal insulation and of cost price. The use of plastics or composites based on polymer resin, in particular with reinforcement fibers, provides the conditions necessary to obtain load-bearing partitions whose manufacture in the form of partitions of any profile, for example a corrugated profile, is fairly easy, while offering a thermal conductivity that is the same as or better than plywood and a lower expansion coefficient. For example, such anti-buckle partitions may be obtained by molding, extrusion or pultrusion of the composite material. It is possible, in particular, to obtain anti-buckle partitions in the form of profiled elements that are cut to the desired height, such that the size of the corresponding non-conducting elements can easily be modified.

Injection-molding is also an appropriate manufacturing process, for example using plastics such as PVC, PC, PBT, PU, PE, PA, PS and other polymer resins.

According to a particular embodiment, said load-bearing partitions of a non-conducting element are formed as a single piece with one said panel of the non-conducting element. A structural piece of this type including a base or cover panel and load-bearing partitions projecting from the latter may be injection-molded. It is also possible to form the load-bearing partitions of a non-conducting element as a single molded piece with arms extending between them in order to link them and to add a base panel and/or a cover panel independent of a piece of this type.

Anti-buckle partitions may also be produced from laminated wood or plywood produced using sheets of wood, for example beech, pine, birch, poplar or the like and mixtures thereof, superposed on and adhesively bonded to one another. A material of this type may be hot-compression-molded, for example with a corrugated profile. It is also possible to use a composite that includes a high proportion of sawdust with a synthetic binder.

Preferably, the non-conducting element includes a base panel on that side of the thermal insulation liner that faces said load-bearing structure, said load-bearing partitions including peripheral partitions projecting from said base panel along its edges in order to form a box. In particular, said load-bearing partitions may delimit a closed space between said base panel and a cover panel. Non-conducting elements of this type in the form of a box, in particular a closed box, make it possible to use all kinds of insulation liner, in particular granular or pulverulent materials. According to a particular embodiment, the non-conducting element includes a plurality of anti-buckle partitions arranged in such a manner as to compartmentalize the inner space of said box, the longitudinal ends of said anti-buckle partitions being fixed to said peripheral partitions.

This fixing may be achieved by any means. Advantageously, said longitudinal ends of the parallel anti-buckle partitions can be flush fitted into said peripheral partitions. Flush-fitting load-bearing partitions of this type offer a very good mechanical link.

According to a particular embodiment, said anti-buckle partitions are arranged in parallel at a distance from one another and have assembly tabs in the region of their two longitudinal ends, said peripheral partitions comprising end partitions arranged perpendicularly to said anti-buckle partitions in the region of the two longitudinal ends of the latter and having, on the face facing said anti-buckle partitions, a plurality of spaced-apart parallel grooves capable of receiving and retaining an assembly tab of a respective anti-buckle partition. The number and spacing of the anti-buckle partitions in a non-conducting element may thus be easily modified by adapting the position and spacing of the grooves.

Advantageously, each of the said end partitions includes a plurality of spaced-apart parallel ribs projecting from the face facing said anti-buckle partitions, said grooves being provided, on each occasion, in a respective rib. The production of the end partition in the form of a thin continuous wall with ribs makes it possible to obtain the desired anti-buckling strength while limiting the thermal bridges in the region of the end partition and maximizing the volume available for the thermal insulation liner in the hollow element.

Preferably, said end partition carries at least one load-distribution sole plate interposed between said thin continuous wall and said base or cover panel of the non-conducting element, said load-distribution sole plate extending in the direction of the length of said end partition and having a width substantially equal to the projection of said ribs. A load-distribution sole plate of this type provided on the upper and/or lower side of the partition stiffens the partition and prevents a concentration of stresses on a particular zone of the partition, which prevents localized pinching of the panel and offers a larger surface area for the link between the partition and the panel.

The peripheral partitions may be rectilinear. According to a particular embodiment, at least some of the peripheral partitions are anti-buckle partitions. In this regard, all the structures provided for the anti-buckle partitions can be applied to the peripheral partitions.

Advantageously, the two insulating barriers consist essentially of non-conducting elements that include, on each occasion, a plurality of mutually parallel anti-buckle partitions, said non-conducting elements being arranged in such a manner that, in any zone of said at least one tank wall, the parallel anti-buckle partitions of the non-conducting elements of an insulating barrier are oriented substantially perpendicularly to the parallel anti-buckle partitions of the non-conducting elements of the other insulating barrier. Such an arrangement of the non-conducting elements of the two insulating barriers reduces the surface area of the zones of the tank wall in which the anti-buckle partitions of the two insulating barriers are superposed, which limits the corresponding thermal bridges. Any other mutual orientation of the elements of the two barriers is also possible, particularly by making all the anti-buckle partitions of the non-conducting elements superposed in the region of a zone of the tank wall parallel.

Preferably, said at least one insulating barrier consisting of said non-conducting elements is covered, on each occasion, by one of said sealing barriers that is formed from thin metal plate strakes with a low expansion coefficient, the edges of which are raised toward the outside of said non-conducting elements, said non-conducting elements including cover panels carrying parallel grooves spaced apart by the width of a plate strake in which weld supports are slideably retained, each weld support having a continuous wing projecting from the outer surface of the cover panel and on whose two faces the raised edges of two adjacent plate strakes are welded in a leaktight manner. This structure and this method of fixing the sealing barrier are preferably used for the two sealing barriers of the tank. The sliding weld supports form gliding joints allowing different barriers to move relative to one another through the effect of differences in thermal contraction and movements of the liquid contained in the tank.

Advantageously, secondary retention members integral with the load-bearing structure of the ship fix the non-conducting elements forming the secondary insulating barrier against said load-bearing structure, and primary retention members linked to said weld supports of the secondary sealing barrier retain said primary insulating barrier against the secondary sealing barrier, said weld supports retaining said secondary sealing barrier against the cover panels of the non-conducting elements of the secondary insulating barrier. Thus, the primary insulating barrier is anchored on the secondary insulating barrier, with no effect on the continuity of the secondary sealing barrier interposed between them.

According to a preferred embodiment, said thermal insulation liner includes reinforced or unreinforced, rigid or flexible foam of low density, i.e. under 60 kg/m$^3$, for example around 40 to 50 kg/m$^3$, which has very good thermal properties. It is also possible to use a material of nanoscale porosity of the aerogel type. A material of the aerogel type is a low-density solid material with an extremely fine and highly porous structure, possibly with a porosity up to 99%. The pore size of these materials is typically in the range between 10 and 20 nanometers. The nanoscale structure of these materials greatly limits the mean free path of the gas molecules, and therefore also convective heat and mass transfer. Aerogels are thus very good thermal insulators, with a thermal conductivity, for example, below $20\times10^{-3}$ W.m$^{-1}$.K$^{-1}$, preferably less than $16\times10^{-3}$ W.m$^{-1}$.K$^{-1}$. They typically have a thermal conductivity 2 to 4 times as low as that of other, conventional insulators, such as foams. Aerogels may be in different forms, for example in the form of powder, beads, nonwoven fibers, fabric, etc. The very good insulating properties of these materials make it possible to reduce the thickness of the insulating barriers in which they are used, which increases the useful volume of the tank.

The invention also provides a floating structure, in particular a methane carrier, characterized in that it comprises a sealed, thermally insulated tank according to the subject of the above invention. A tank of this type may, in particular, be employed in an FPSO (floating, production, storage and off-loading) facility, used to store the liquefied gas with a view to exporting it from the production site, or an FSRU (floating storage and regasification unit) used to unload a methane carrier with a view to supplying a gas transportation system.

The invention will be better understood and further objects, details, characteristics and advantages thereof will become more clearly apparent in the course of the following description of a plurality of particular embodiments of the invention that are given solely by way of non-limiting illustrative example with reference to the appended drawings, in which.

A description will be given below of several embodiments of a sealed, thermally insulated tank incorporated in and anchored to the double hull of a structure of the FPSO or FSRU type or of a methane-type carrier. The general structure of such a tank is well known per se and has a polyhedral form. Therefore, a description will be given only of a wall zone of the tank, it being understood that all the walls of the tank have a similar structure.

Figure 1:
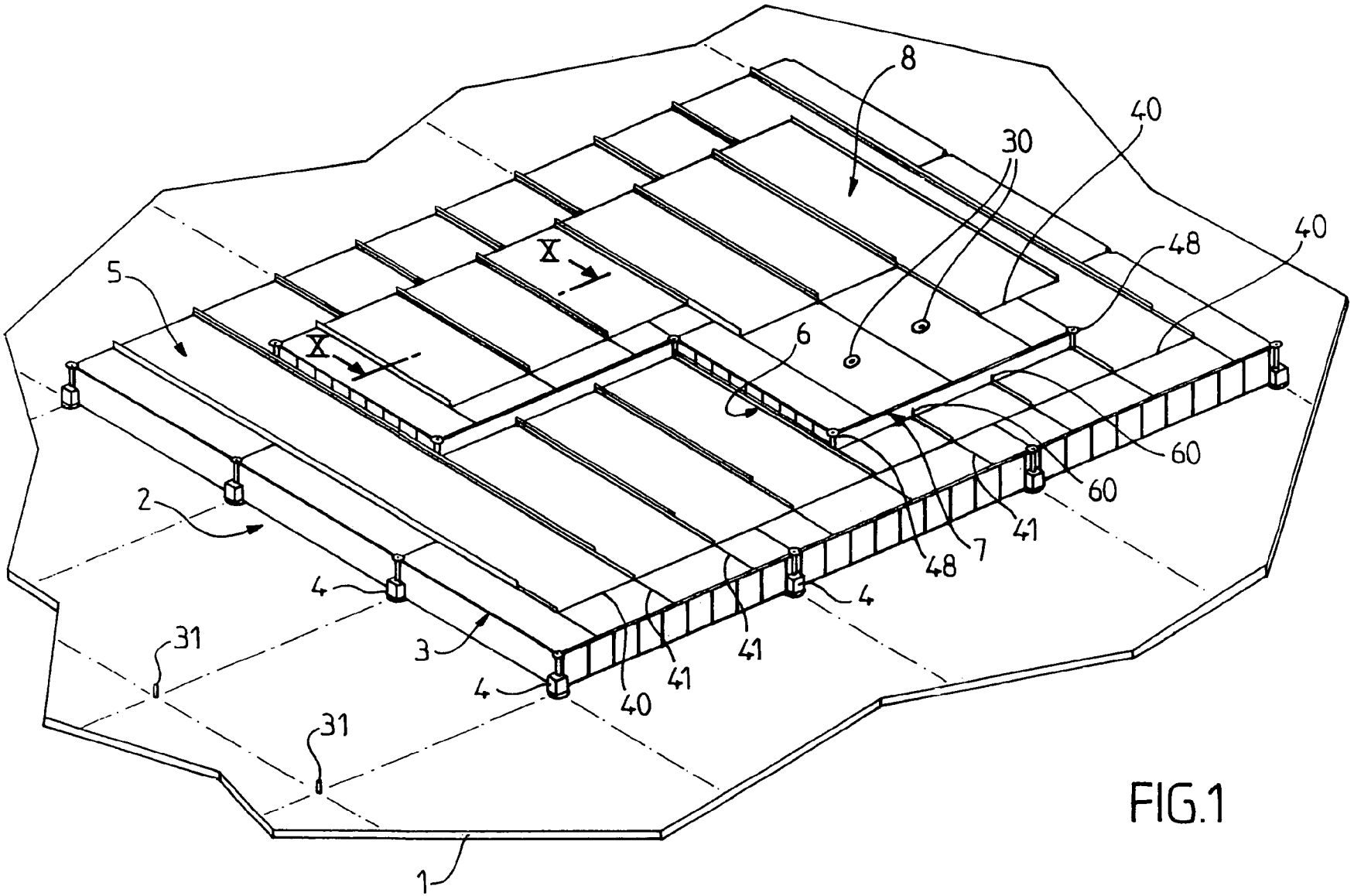
FIG. 1 is a stripped-back perspective view of a tank wall according to one embodiment of the invention.

A description is now given of an embodiment with reference to FIGS. 1 to 12. FIG. 1 shows a zone of the double hull of the ship, denoted by 1. The tank wall is composed, in succession, in its thickness, of a secondary insulating barrier 2 formed from caissons 3 juxtaposed on the double hull 1 and anchored to the latter by means of secondary retention members 4, then a secondary sealing barrier 5 carried by the caissons 3, then a primary insulating barrier 6 formed from juxtaposed caissons 7 anchored to the secondary sealing barrier 5 by primary retention members 48, and finally a primary sealing barrier 8 carried by the caissons 7.

The caissons 3 and 7 may have identical or different structures and identical or different dimensions. With reference to FIGS. 2 to 8, a description is now given of a caisson 3 of the secondary insulating barrier. As may be seen in FIGS. 2 and 3, the caisson 3 has a rectangular parallelepipedal global shape. It includes a base panel 10 in plywood, for example 6.5 mm thick, and a cover panel 11 in plywood, for example 12 mm thick. The panels 10 and 11 are, respectively, bonded on either side of a plurality of load-bearing spacing elements made from composite material that delimit a hollow space 12 inside the caisson 3. These spacing elements are, on the one hand, two end partitions 13 forming two opposite lateral walls of the caisson 3 and, on the other hand, a plurality of corrugated anti-buckle partitions 14 (ten in number in the example shown), arranged in parallel and spaced from one another between the two end partitions 13 in a direction perpendicular to the latter.

Figures 4, 5, 6, 7, 8, 9:
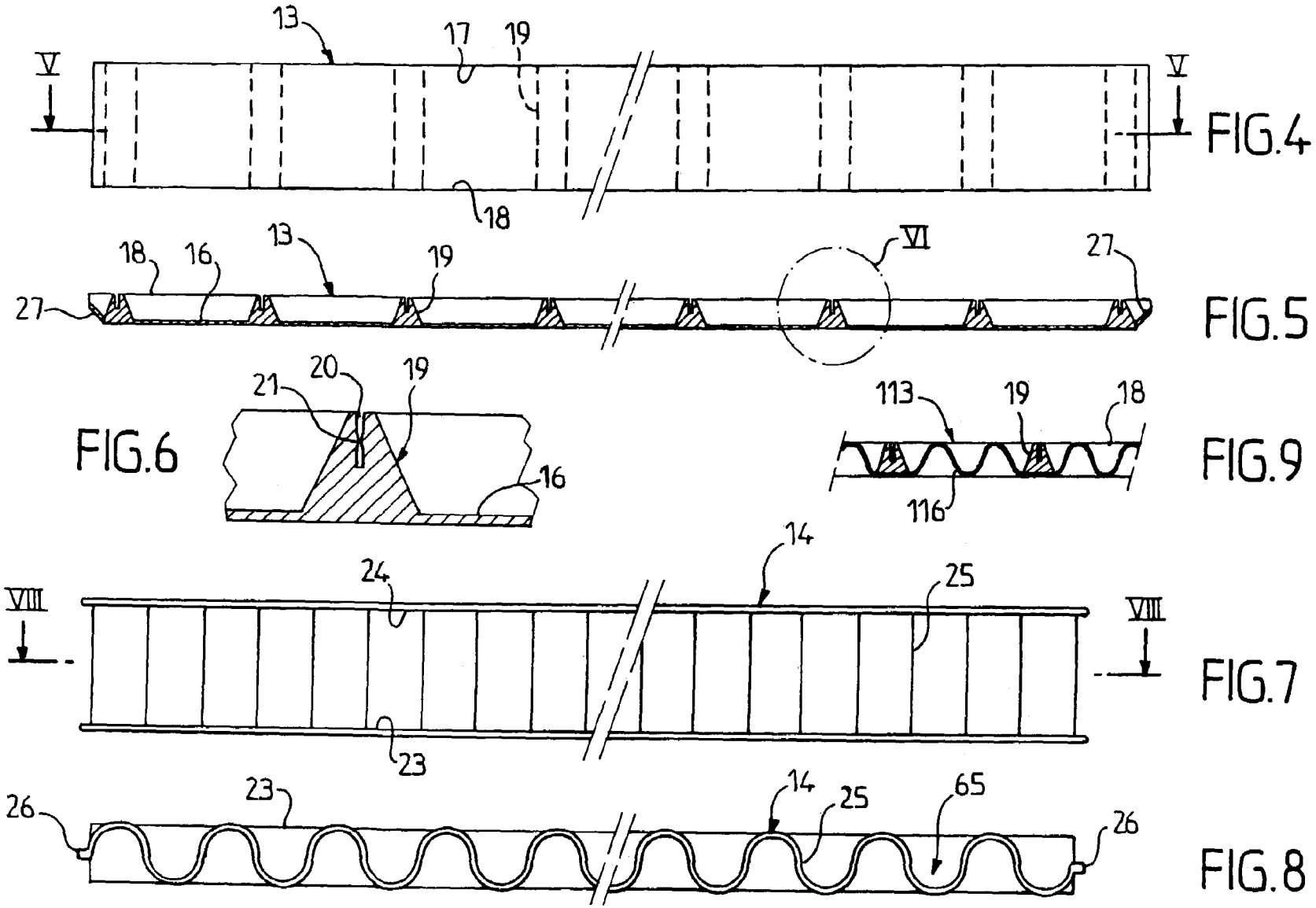
FIG. 4 shows an end partition of the caisson of FIG. 2.
FIG. 5 shows a view of the partition of FIG. 4 in section on line V-V.
FIG. 6 shows a detail of FIG. 5.
FIG. 7 shows an anti-buckle partition of corrugated type of the caisson of FIG. 2.
FIG. 8 shows a view of the corrugated partition of FIG. 7 in section on line VIII-VIII.
FIG. 9 shows a variant embodiment of the end partition of FIG. 4, in partial view.

The end partitions 13 are shown in FIGS. 4 to 6. The end partition 13 has a rectilinear continuous wall 16, for example with a thickness of approximately 2 mm, with a lower sole plate 18 and an upper sole plate 17 extending over its entire length and projecting from the inner side of the wall 16. On this inner side, between the sole plates 17 and 18, the wall 16 carries a series of vertical ribs 19 of triangular cross section that are parallel and spaced apart at regular intervals, which serve as flush-fitting members for the corrugated partitions 14. As may be better seen in FIG. 6, each rib 19 has a groove 20 that has, in its depth, an intermediate narrowing 21 serving to retain the end of a corrugated partition 14 by means of snap-fitting.

A corrugated partition 14 is shown in FIGS. 7 and 8. The corrugated partition 14 includes a continuous corrugated wall 25, for example with a thickness of 2 mm, with a lower sole plate 23 and an upper sole plate 24 on its two opposite edges. The sole plates 23 and 24 have the same width as the corrugations of the wall 25. In the region of its two ends, the corrugated wall 25 has rectilinear lugs 26 designed to flush fit in the grooves 20 of the end partitions 13 by deforming the narrowings 21 elastically. Robust flush-fitting of the corrugated partitions 14 in the end partitions 13 is thus achieved, which can also be reinforced by adhesive bonding.

Figure 2:
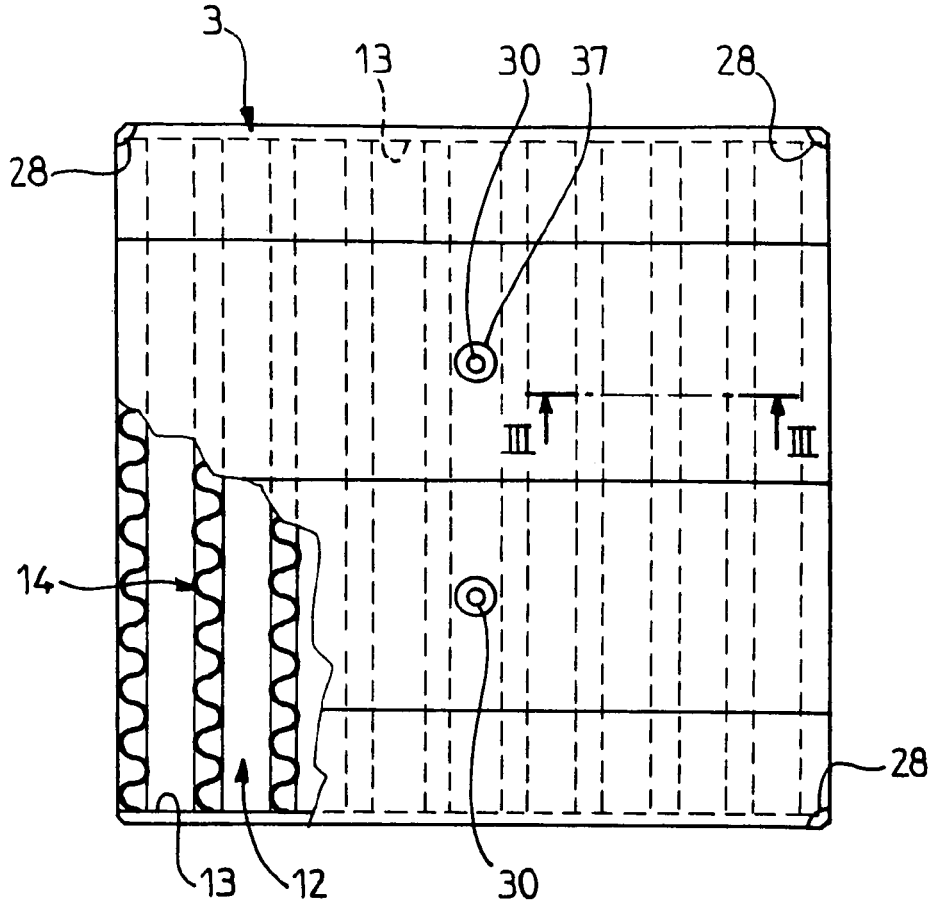
FIG. 2 is a stripped-back plan view of an insulating caisson of the tank wall shown in FIG. 1.
Figure 3:
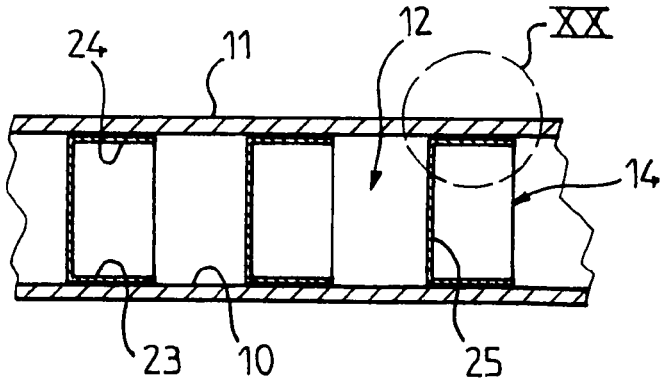
FIG. 3 is a partial view of the insulating caisson of FIG. 2 in section on line III-III.

The caisson 3 has cut corners that are formed by a corresponding cutoff of the sole plates 17 and 18 of the end partitions 13 and by an inclined end border of the continuous wall 16, denoted by 27. In the region of the corners of the caisson 3, the cover panel 11 has countersinkings 28 for receiving a washer of the secondary retention member 4. The caisson 3 also has two central shafts 30 traversing the panels 10 and 11 and the insulating liner housed between them and forming supplementary anchor points for the caisson 3. FIG. 2 omits to show two grooves made in the cover panel 11 parallel to the corrugated partitions 14 in order to receive weld supports of the secondary sealing barrier, as will be explained below.

By virtue of their form, the corrugated partitions 14 have a high anti-buckling resistance without it being necessary to provide the wall 25 with any great thickness. Thus, the free space 12 in the caissons 3 is maximized. This free space receives a thermal insulation liner that may be made from any appropriate material, for example low-density polyurethane foam, for example with a density of approximately 40 kg/m$^3$, phenolic foam, flexible PE, PVC or other foams, nanoporous materials of the aerogel type, pearlite, glass wool or the like. This liner is preferably also inserted in the open cells 65 that are formed on either side of the corrugated wall 25.

The end partitions 13 and the corrugated partitions 14 are manufactured from a polymer-resin-based composite material, for example polyester resin or epoxy resin reinforced with glass or carbon fibers. Preferably, the end partitions 13 and the corrugated partitions 14 are obtained by injection-molding.

FIG. 9 shows a variant embodiment of the end partition denoted by 113. In this variant embodiment, the continuous wall 116 is not rectilinear but has, on the contrary, corrugations in a manner similar to the wall 25 of the corrugated partitions 14, which makes it possible to obtain a greater anti-buckling resistance. Furthermore, the same reference numerals denote identical elements to the preceding embodiment of the end partition.

A number of modifications are possible to the caisson 3 described above. For example, the base panel 10 may be dispensed with, at least when the insulation liner of the caisson is a foam or a rigid material that can be adhesively bonded to the inner face of the cover panel 11 and to the partitions 13 and 14. In a variant embodiment, it is possible to dispense with the cover panel 11. In such a case, the sealing barrier supported by the caisson 3 will rest on the sole plates 24 of the partitions 14, which could be widened for this purpose, and optionally on the masses of insulating material placed in the compartments 12. In such a case, the members ensuring attachment of the caisson may bear on the inner face of the base panel 10 or on the outer face of the sole plates 24.

Figure 20:
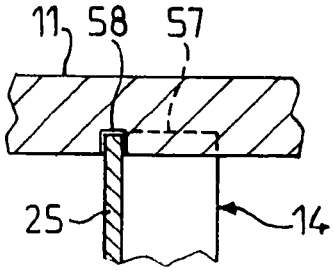
FIG. 20 is an enlarged view of the zone XX of FIG. 3, in a variant embodiment of the caisson.

According to a variant embodiment shown in FIG. 20, the upper sole plate 24 of the partitions 14 is dispensed with and flush-fitting is achieved between the partitions 14 and the cover panel 11. To that end, grooves 58 are machined in the inner face of the panel 11 and receive the upper edge 57 of the corrugated wall 25, preferably over the entire length of the latter. Flush-fitting may be achieved in a similar fashion with the base panel 10.

According to yet a further variant embodiment (not shown), a piece that includes not only the base panel 10 but also the partitions 13 and 14 projecting from it could be injection-molded. Thus, the assembly of the caisson is particularly simplified.

Figure 13:
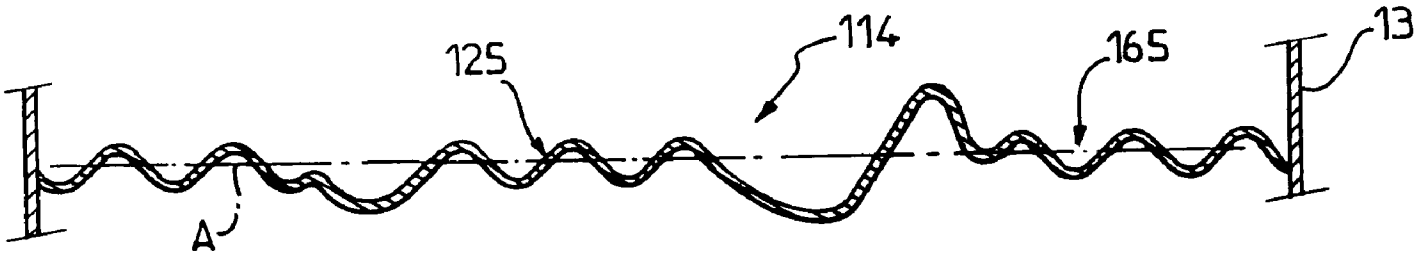
FIGS. 13 to 19 are views similar to FIG. 8, showing other variant embodiments of the anti-buckle partitions that can be used according to the invention.
Figure 14:
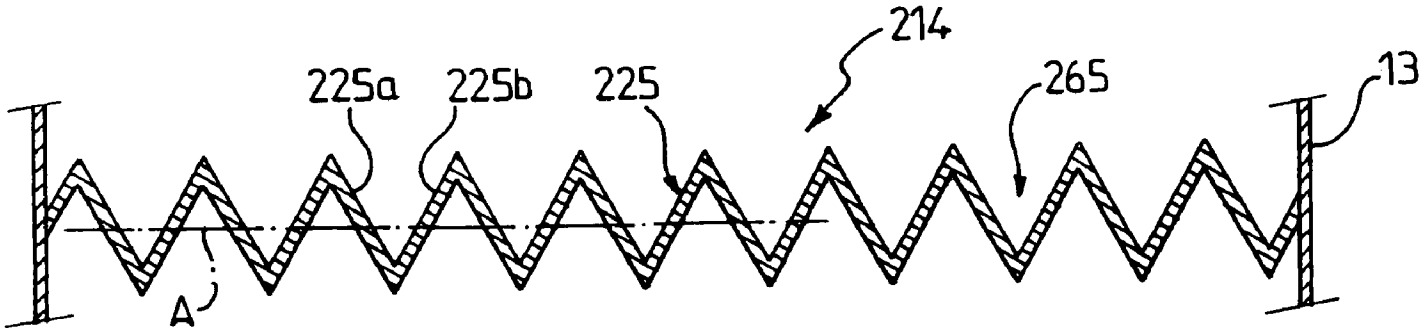
Figure 15:
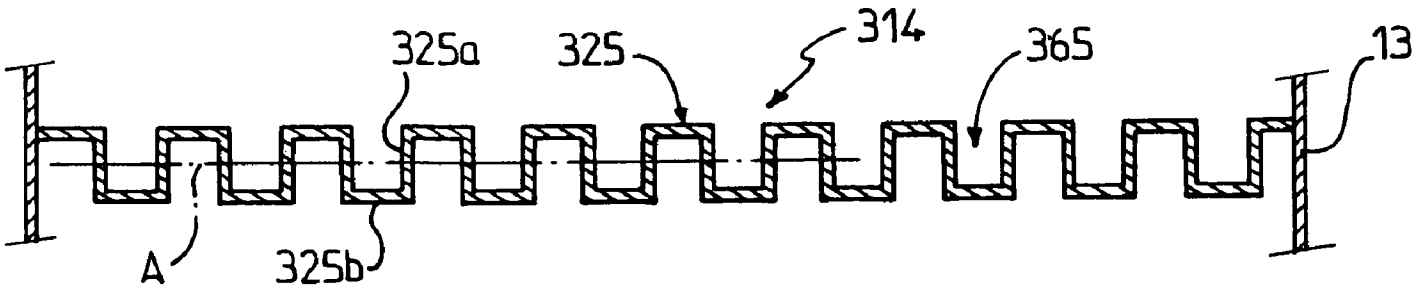

The form of the profile of the anti-buckle partitions is not limited to the form of alternate half-circles visible in FIG. 8. FIGS. 13 to 15 show further embodiments of the anti-buckle partitions that can be used in the caissons 3 and 7, with or without load-distribution sole plates. Other forms of profile are obviously possible.

The partition 114 shown in FIG. 13 has a continuous thin wall 125 whose profile is corrugated on either side of a median longitudinal line A of the partition. The wall 125 thus defines open cells 165 on each side of the partition 114. Purely by way of illustration, the partition 114 has been given an irregular profile, with oscillations having different lengths and different transverse amplitudes. A substantially sinusoidal periodic profile is also possible.

The partition 214 shown in FIG. 14 has a continuous thin wall 225 whose profile is in the form of triangular teeth. The wall 225 is formed from a succession of planar anti-buckle wall elements 225*a* and 225*b* extending obliquely relative to the median longitudinal line A of the partition, with a direction of inclination that alternates each time. Open cells 265 are, on each occasion, formed by the angular sector between two wall elements 225*a* and 225*b*.

The partition 314 shown in FIG. 15 has a continuous thin wall 325 whose profile is in the form of rectangular crenelations. The wall 325 is formed from a succession of planar wall elements, i.e. alternately elements 325*a* that are transverse relative to the longitudinal direction of the partition and longitudinal elements 325*b* located on either side of the median longitudinal line A.

FIGS. 13 to 15 also show sketches of the end partitions 13 whose means of flush-fitting with the ends of the anti-buckle partitions are not shown. Means of this type are not, however, necessary when inter-partition assembly is achieved by other means (adhesive bonding, stapling, etc.)

Figure 16:
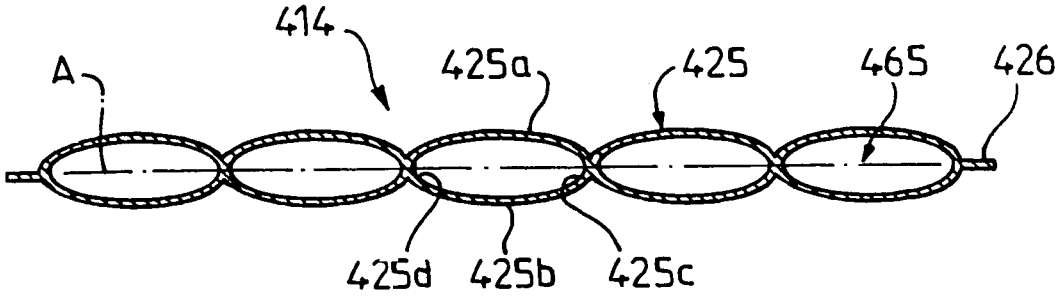
Figure 17:
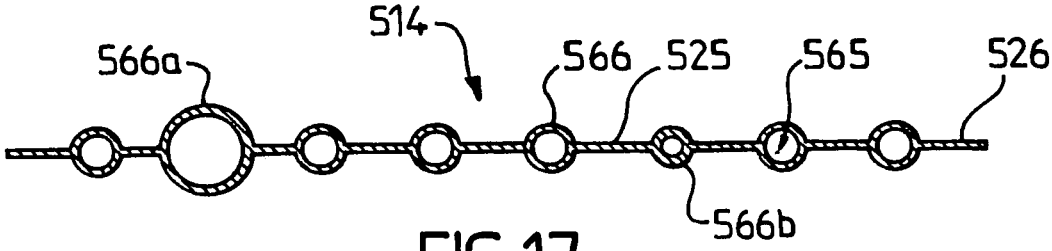
Figure 18:
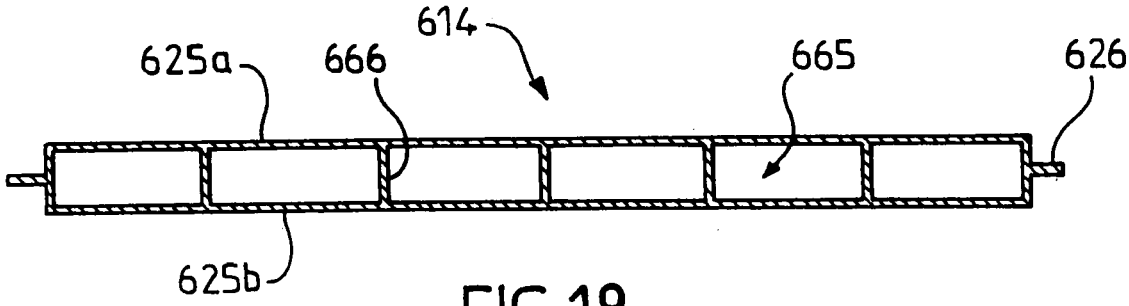

FIGS. 16 to 18 show yet further embodiments of the anti-buckle partitions that can be used in the caissons 3 and 7 and have cells with a closed cross section. These cells may be left empty or be lined with thermal insulation that may or may not be identical to the insulation liner placed between the partitions, or alternatively receive mechanical reinforcement elements made from wood, plastic or the like.

The partition 414 shown in FIG. 16 has a cellular double wall consisting of a series of hollow elliptical cylindrical portions 425 linked via the ends of their respective major axis, these aligned axes forming the median longitudinal line A of the partition. Each cylindrical portion 425 consists of a plurality of curved wall portions enclosing a cell space 465, i.e. two somewhat longitudinal wall portions 425*a* and 425*b* spaced apart laterally and connected in the region of their ends via two somewhat transverse wall portions 425*c* and 425*d*, which form anti-buckle wall elements. The join between two adjacent cylindrical portions 425 is the result of the portion 425*c* of one and the portion 425*d* being fused at their centers. Each end cylindrical portion may be provided with a longitudinal tab 426 for flush-fitting in an end partition 13. Cells of all forms may be produced in a similar manner.

The partition 514 shown in FIG. 17 has, locally, a cellular double wall consisting of hollow circular cylindrical portions 566, 566*a*, 566*b* enclosing cell spaces 565 and linked by means of planar single wall elements 525. Planar wall elements 526 may be provided at the longitudinal ends of the partition 514 for flush-fitting in an end partition 13. Cells of all forms may be produced in a similar manner. Purely by way of illustration, cylindrical portions 566, 566*a* and 566*b* having three different diameters have been shown. It is also possible to use cylindrical portions having the same diameter.

The partition 614 shown in FIG. 18 has a cellular double wall consisting of two laterally spaced parallel planar walls 625*a* and 625*b* extending over the entire length of the partition and connected at regular intervals by transverse planar wall elements 666 that, on each occasion, close cell spaces 665 between the walls 625*a* and 625*b*. The ends of the partition 614 may be provided with tabs 626 for flush-fitting in an end partition 13. Other forms of cells may be produced in a similar manner.

Figure 19:
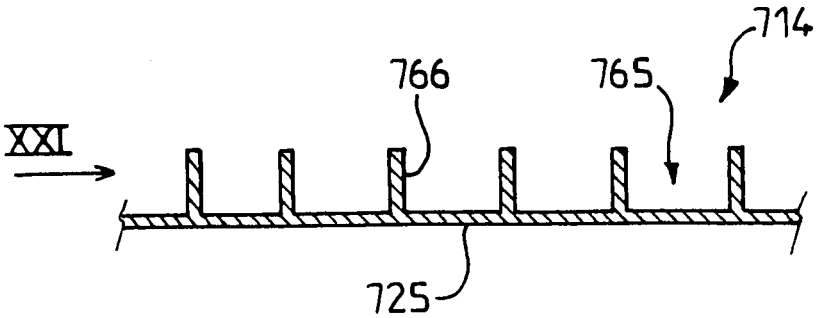
Figure 21:
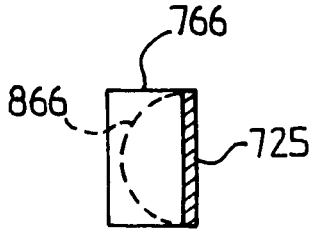
FIG. 21 shows the anti-buckle partition of FIG. 19 in transverse view, in accordance with the arrow XXI.

FIG. 19 shows a further embodiment of the anti-buckle partitions that can be used in the caissons 3 and 7. The partition 714 shown in FIG. 19 includes a longitudinal planar continuous thin wall 725. Planar wall elements 766 project from one or from both sides of the wall 725 in order to form buttresses that increase the transverse moment of inertia of the partition. An open cell 765 is formed, on each occasion, between two wall elements 766. As may be seen in FIG. 21, the wall element 766 may have a uniform transverse section over its entire height or, alternately, a cross section that varies in the direction of the height of the partition 714, like the cross section shown by way of example in broken line, denoted by 866.

Figure 22:
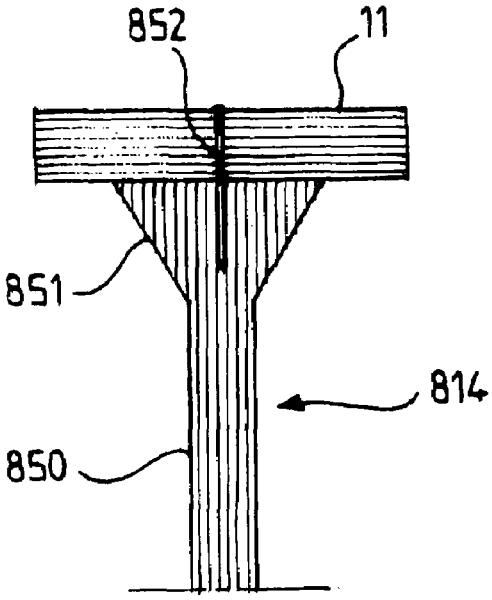
FIG. 22 is a view similar to FIG. 20, showing a variant embodiment of an anti-buckle partition that can be used according to the invention.
Figure 23:
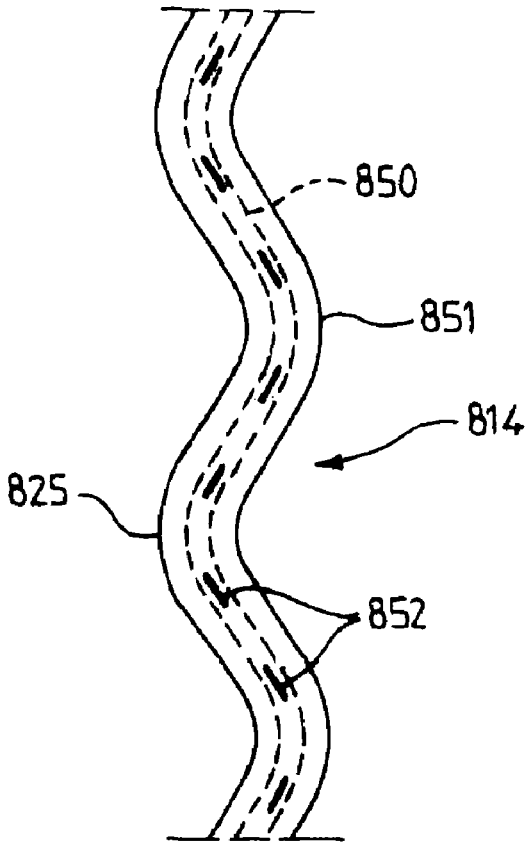
FIG. 23 is a plan view of the partition of FIG. 22.

FIGS. 22 and 23 show a further embodiment of the anti-buckle partitions that can be used in the caissons 3 and 7. In this embodiment, the partition 814, for example made from plywood, has an intermediate part 850 arranged between a head part 851 in contact with the cover panel 11 and a foot part (not shown) in contact with the base panel 10. The foot part is similar to the head part 851 and will therefore not be described in detail. As shown in FIG. 23, the partition 814 has undulations 825.

As shown in FIG. 22, the head part 851 has a prismatic form having a thickness that increases toward the panel 11. A configuration of this type is particularly advantageous when the intermediate part 850 is thin and therefore fragile. Thus, the width of the contact surface between the partition 814 and the panel 11 is greater than the thickness of the intermediate part 850, which makes it possible to fix the partition 814 to the panel 11 using staples 852 without risk of damage to the partition 814 and, in particular, in the case of a plywood partition, without risk of delaminating the wood. Furthermore, the head part 851 also has the effect of distributing loads. In FIG. 2, the lateral contour of the caisson 3 is delimited by two substantially planar end partitions 13 on two opposite sides and by two anti-buckle partitions 14 on the other two opposite sides. Other arrangements are possible. For example, provision may be made for planar partitions parallel to the anti-buckle partitions in order to form lateral edges of the caisson 3 or 7. Thus, in one embodiment (not shown) the lateral contour of the caisson is entirely formed from planar partitions, which simplifies the geometry of the gaps between the caissons and improves their closure.

Figure 10:
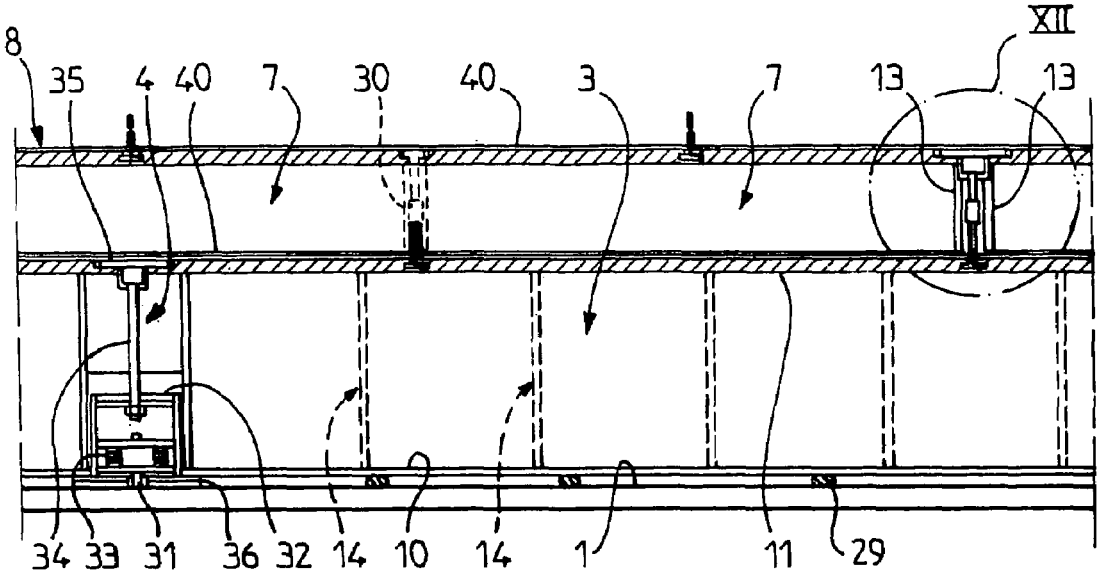
FIG. 10 is a view of the tank wall of FIG. 1 in section on line X-X.
Figure 12:
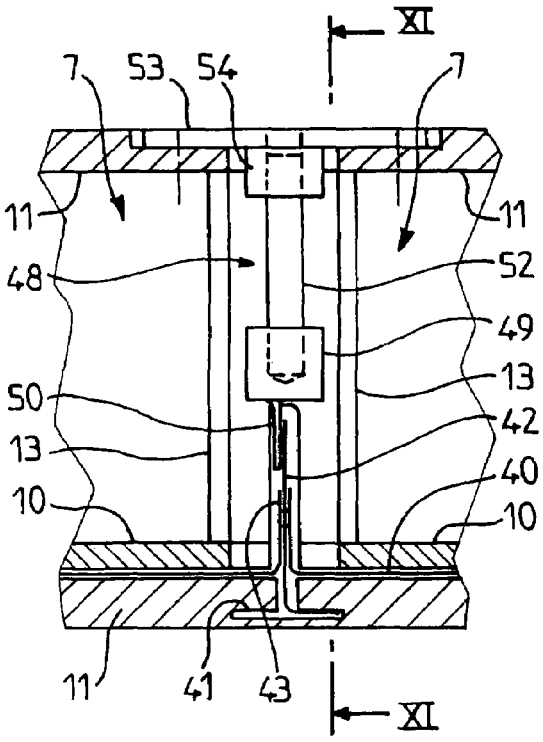
FIGS. 11 and 12 show a primary retention member of the tank wall of FIG. 1, seen in two perpendicular directions.
Figure 11:
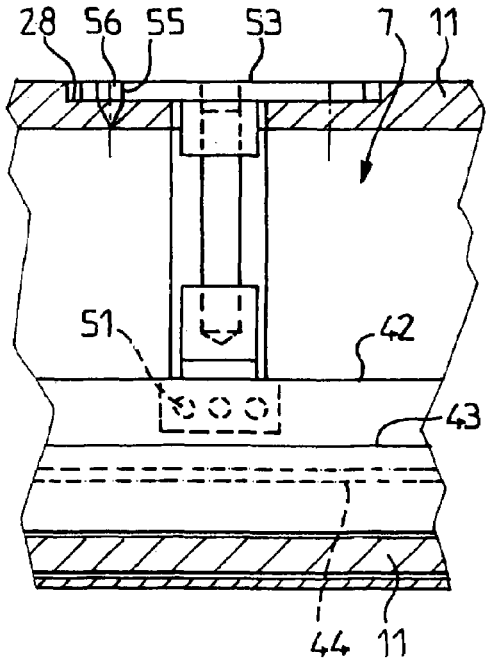

With reference to FIGS. 1 and 10, a description is now given of the anchoring of the tank walls on the double hull 1. Secondary retention members 4 are fixed to the double hull 1 in a regular rectangular grid pattern so that these retention members 4, on each occasion, retain four caissons 3, whose corners meet. Provision is also made for two secondary retention members 4 in the central zone of each caisson 3, these being engaged via the shafts 30 shown in FIG. 2.

As may be seen in FIG. 10, a secondary retention member 4 includes a pin 31 welded to the double hull 1, to which a plate 32 is fixed elastically be means of Belleville washers 33. The plate 32 carries a rod 34 whose opposite end carries a washer 35 bearing on the four caissons, engaging in the countersinkings 28 of the cover panels 11 or in the countersinkings 37 provided in the region of the shafts 30. It will be appreciated that, in the region of the shafts 30, the base panel 10 has an opening to allow the plate 32 to pass through. The elasticity of the secondary retention member 4 serves to absorb the deformations of the ship's hull caused by the swell, in order to limit the corresponding flexing of the caissons 3, which is all the more necessary the larger these are. For example, the caissons 3 may be squares with sides of 1.5 m.

As the geometry of the double hull 1 is irregular, provision is made for shims 36 around threaded pins 31. The thickness of each shim 36 is calculated by computer on the basis of a topographical survey of the inner surface of the double hull 1. Thus, the base panels 10 are positioned along a theoretical regular surface. Between the base panels 10 and the double hull 1, provision is conventionally made for beads of polymerizable resin 29 that are adhesively bonded to the base panels 10 and are crushed against the double hull when the caissons 3 are fitted, so as to provide their support. To avoid this resin adhering to the double hull, a sheet of Kraft paper (not shown) is provided between them.

The secondary sealing barrier 5 is produced in accordance with the known technique in the form of a membrane consisting of Invar plate strakes 40 with raised edges. As may be seen better in FIG. 12, the cover panels 11 of the caissons 3 have longitudinal grooves, with an inverted-T-shaped cross section, denoted by 41. A weld support 42 in the form of a strip of Invar folded in the form of an L, is inserted slideably in each groove 41. Each plate strake 40 extends between two weld supports 42 and has two raised edges 43 welded, on each occasion, continuously by a weld bead 44 to the corresponding weld support 42, as may be seen in FIG. 11.

As was stated, the caissons 7 of the primary insulating barrier may have a structure similar to the caissons 3. Similarly, in such a case, the caissons 7 are anchored, on each occasion, to the four corners and at two points in the central zone of the caisson 7. To that end, use is made, on each occasion, of a primary retention member 48 shown in detail in FIGS. 11 and 12. The primary retention member 48 has a lower sleeve 49 integral with a lug 50 welded at three points 51 of a weld support 42 above the raised edges 43 of the plate strakes 40. A rod 52 made from Permali, a composite material based on resin-impregnated beech wood, has a lower end fixed in the lower sleeve 49 and an upper end fixed in a sleeve 54 integral with a support washer 53 that bears on the cover panels 11 of the caissons 7, being accommodated in countersinks 28 at the corners of the caissons 7 and in the countersinkings 37 at the shafts 30. The sleeve 54 is threaded and is screwed onto a corresponding threaded end of the rod 52. When the washer 53 has been thus positioned, immobilizing screws 56 are engaged through holes 55 provided in the washer 53 and screwed into the panel 11 in order thus to prevent any subsequent rotation of the washer 53. In each insulating barrier, the caissons 3 and 7 are juxtaposed with a small intermediate space of the order of 5 mm.

It will be appreciated that the weld supports 42 retaining the secondary sealing barrier 5 pass either between the caissons 7 of the primary insulating barrier or in the middle of these caissons. In such a case, the base panel 10 of the caisson 7 has a corresponding longitudinal notch for the passage of the weld support 42, which longitudinal notch is shown by 60 in FIG. 1. The structure and anchoring of the primary sealing barrier 8 are completely similar to the secondary sealing barrier 5.

The caissons 3 and 7 are self-supporting caissons capable of withstanding the pressure of the liquid in the tank, such that the sealing barriers 5 and 8 supported by them have no need themselves to support this pressure and are advantageously produced in the form of very thin membranes with a thickness, for example, of 0.7 mm of Invar. Preferably, the caissons 3 and 7 are arranged in such a manner that their respective anti-buckle partitions 14 (or 114, 214, etc.) are perpendicular.

Advantageously, a layer of nanoporous materials of the aerogel type, which are very good thermal insulators, is included as insulation liner in the caissons 3 and/or 7. Aerogels also have the advantage of being hydrophobic, so absorption of the moisture from the boat into the insulating barriers is thus prevented. An insulation layer may be produced with aerogels, possibly pocketed, in textile form or in the form of beads. Of course, the insulation liner of a non-conducting element may include several layers of material.

Generally speaking, aerogels may be made from a number of materials, including silica, alumina, hafnium carbide and also varieties of polymers. Furthermore, in accordance with the manufacturing process, aerogels may be produced in powder, bead, monolithic sheet and reinforced flexible fabric form. Aerogels are generally manufactured by extracting or displacing the liquid of a gel of micronic structure. The gel is typically manufactured by means of chemical conversion and reaction of one or more dilute precursors. This results in a gel structure in which a solvent is present. Use is generally made of hypercritical fluids such as $CO_2$ or alcohol, to displace the gel solvent. Aerogels' properties may be modified by using a variety of doping and reinforcement agents.

The use of aerogels as insulation liners significantly reduces the thickness of the primary and secondary insulating barriers. It is, for example, possible to conceive of barriers 2 and 6 having a thickness of 200 mm and 100 mm, respectively, with a woven aerogel bed in the caissons 3 and 7, the tank wall then having a total thickness of 310 mm. It is possible to conceive of a tank wall having a total thickness of 400 mm by making provision for a layer of aerogel particles in the caissons 3 and 7.

An anti-buckle partition may have any orientation relative to the edges of the base and/or or cover panels, i.e. parallel or non-parallel. The anti-buckle partitions of a non-conducting element are not necessarily mutually parallel. Although a description has been given of essentially parallelepipedal, right-angled non-conducting elements, other forms of cross section are possible, notably any polygonal form capable of rendering a planar surface discrete. When the hull serving as support for the tank wall is not planar, the tank wall may be produced using non-conducting elements that are also non-planar.

When one of the primary and secondary insulating barriers is produced with the aid of the non-conducting elements described above, it is possible, but not necessary, to produce the other insulating barrier in an identical manner. Non-conducting elements of two different types may be used in the two barriers. One of the barriers may consist of prior-art non-conducting elements.

The caissons of the secondary insulating barrier and of the primary insulating barrier may be anchored to the ship's hull in a different way from the example shown in the figures, for example with the aid of retention members engaged on the base panel of the caissons.

Although the invention has been described in connection with a number of particular embodiments, it is obviously not limited to these in any way and includes all technical equivalents of the means described and also combinations thereof if they fall within the scope of the invention.

The invention claimed is:

1. Sealed, thermally insulated tank including at least one tank wall fixed to the load-bearing structure (1) of a floating structure, said tank wall having, in succession, in the direction of the thickness from the inside to the outside of said tank, a primary sealing barrier (8), a primary insulating barrier (6), a secondary sealing barrier (5) and a secondary insulating barrier (2), at least one of said insulating barriers consisting essentially of juxtaposed non-conducting elements (3, 7), each non-conducting element including a thermal insulation liner arranged in the form of a layer parallel to said tank wall, at least one panel (10, 11) extending parallel to said tank wall over at least one side of said thermal insulation liner and load-bearing partitions projecting from a face of said at least one panel facing said thermal insulation liner, said load-bearing partitions rising through the thickness of said thermal insulation liner in order to take up compression forces, characterized in that said load-bearing partitions include at least one anti-buckle partition (14, 114, 214, 314, 414, 514, 614, 714, 814) that, seen in cross section in a plane parallel to said at least one panel, has a general longitudinal direction (A) and includes a plurality of anti-buckle wall elements (25, 125, 225*a-b*, 325*a*, 425*c-d*, 566, 666, 766, 866, 825) that have a respective orientation forming an angle relative to said general longitudinal direction (A) of the anti-buckle partition.

2. Sealed, thermally insulated tank according to claim 1, characterized in that said anti-buckle partition (14, 114, 214, 314) includes an anti-buckle wall (25, 125, 225, 325) that includes anti-buckle wall elements (25, 125, 225*a-b*, 325*a*) linked together directly or indirectly and that, seen in cross section in a plane parallel to said at least one panel, extends in said general longitudinal direction (A) of said anti-buckle partition with a profile that deviates laterally on either side of a longitudinal median line (A) of said anti-buckle partition (14, 114, 214, 314).

3. Sealed, thermally insulated tank according to claim 1, characterized in that said anti-buckle partition (614, 714) includes a wall (625*a*, 725) extending in said general longitudinal direction (A) and to which anti-buckle wall elements (666, 766, 866) projecting from said wall are linked.

4. Sealed, thermally insulated tank according to claim 1, characterized in that the anti-buckle wall elements (25, 125, 225*a-b*, 325*a*, 766) are arranged so as to delimit longitudinally a plurality of successive cells (65, 165, 265, 365, 765) that, seen in a plane parallel to said at least one panel, have an open cross section.

5. Sealed, thermally insulated tank according to claim 3, characterized in that said anti-buckle partition (614) includes a second wall (625*b*) extending in said general longitudinal direction and spaced apart from the first wall (625*a*) in the transverse direction of the partition, said two walls being connected by a plurality of anti-buckle wall elements (666) arranged between them.

6. Sealed, thermally insulated tank according to claim 1, characterized in that the anti-buckle partition (414, 514) includes double-wall longitudinal portions (465, 565) that include, on each occasion, two laterally spaced wall elements (425*a-b*, 566) and, in the region of the longitudinal ends of said portion, anti-buckle wall elements connecting said laterally spaced wall elements.

7. Sealed, thermally insulated tank according to claim 6, characterized in that the anti-buckle partition (514) includes single-wall longitudinal portions (525) inserted between the double-wall longitudinal portions (565).

8. Sealed, thermally insulated tank according to claim 1, characterized in that, apart from in the region of its ends, said anti-buckle partition (14, 214, 314, 414, 614, 714) has a periodic structure in the general longitudinal direction (A).

9. Sealed, thermally insulated tank according to claim 1, characterized in that said anti-buckle partition (14, 114, 214, 314, 414, 514, 614, 714) has a height direction substantially perpendicular to said at least one panel.

10. Sealed, thermally insulated tank according to claim 1, characterized in that said anti-buckle partition (14) is fitted into at least one said panel (11).

11. Sealed, thermally insulated tank according to claim 1, characterized in that said load-bearing partitions of a non-conducting element are formed as a single piece with one said panel of the non-conducting element.

12. Sealed, thermally insulated tank according to claim 1, characterized in that said anti-buckle partition (14) includes at least one load-distribution sole plate (23, 24, 851) in the region of an edge of said anti-buckle partition facing one said panel (10, 11) of the non-conducting element (3), said load-distribution sole plate extending in the direction of the length of said anti-buckle partition and having a planar surface fixed against said panel (10, 11).

13. Sealed, thermally insulated tank according to claim 1, characterized in that said anti-buckle partition includes at least one load-distribution sole plate (23, 24) in the region of an edge of said anti-buckle partition opposite said panel (11, 10) of the non-conducting element (3), said load-distribution sole plate extending in the direction of the length of said anti-buckle partition and having a planar surface bearing against the adjacent sealing barrier (58).

14. Sealed, thermally insulated tank according to claim 1, characterized in that said non-conducting element includes a base panel (10) on that side of the thermal insulation liner that faces said load-bearing structure, said load-bearing partitions including peripheral partitions (13, 14) projecting from said base panel along its edges in order to form a box.

15. Sealed, thermally insulated tank according to claim 14, characterized in that said non-conducting element includes a plurality of anti-buckle partitions (14) arranged in such a manner as to compartmentalize an inner space of said box, the longitudinal ends of said anti-buckle partitions being fixed to said peripheral partitions (13).

16. Sealed, thermally insulated tank according to claim 15, characterized in that said longitudinal ends of the anti-buckle partitions (14, 114, 214, 314, 414, 514, 614, 714) can be fitted into said peripheral partitions (13).

17. Sealed, thermally insulated tank according to claim 16, characterized in that said anti-buckle partitions are arranged in parallel at a distance from one another and have assembly tabs (26, 426, 526, 626) in the region of their two longitudinal ends, said peripheral partitions comprising end partitions (13) arranged perpendicularly to said anti-buckle partitions in the region of the two longitudinal ends of the latter and having, on the face facing said anti-buckle partitions, a plurality of spaced-apart parallel grooves (20) capable of receiving and retaining an assembly tab of a respective anti-buckle partition.

18. Sealed, thermally insulated tank according to claim 17, characterized in that each of said end partitions includes a plurality of spaced-apart parallel ribs (19) projecting from a face facing said anti-buckle partitions, said grooves being provided, on each occasion, in a respective rib.

19. Sealed, thermally insulated tank according to claim 1, characterized in that the two insulating barriers (2, 6) consist essentially of non-conducting elements (3, 7) that include, on each occasion, a plurality of mutually parallel anti-buckle partitions, said non-conducting elements being arranged in such a manner that, in any zone of said at least one tank wall, the parallel anti-buckle partitions (14) of the non-conducting elements (3) of an insulating barrier (2) are oriented substantially perpendicularly to the parallel anti-buckle partitions of the non-conducting elements (7) of the other insulating barrier (6).

20. Sealed, thermally insulated tank according to claim 1, characterized in that said at least one insulating barrier (2, 6) consisting of said non-conducting elements (3, 7) is covered, on each occasion, by one of said sealing barriers (5, 8) that is formed from thin metal plate strakes (40) made from thin metal sheet with a low expansion coefficient, the edges (43) of which are raised toward the outside of the cover panels of said non-conducting elements, said non-conducting elements having cover panels (11) carrying parallel grooves (41) spaced apart by the width of a plate strake in which weld supports (42) are slideably retained, each weld support having a continuous wing projecting from the outer face of the cover panel and on whose two faces the raised edges of two adjacent plate strakes are welded in a leaktight manner.

21. Sealed, thermally insulated tank according to claim 20, characterized in that the secondary retention members (4) integral with the load-bearing structure (1) of the floating structure fix the non-conducting elements (3) for forming the secondary insulating barrier against said load-bearing structure, and in that primary retention members (48) linked to said weld supports (42) of the secondary sealing barrier retain said primary insulating barrier (6) against the secondary sealing barrier (5), said weld supports retaining said secondary sealing barrier against the cover panels of the non-conducting elements of the secondary insulating barrier.

22. Floating structure, characterized in that it comprises a sealed, thermally insulated tank according to claim 1.

23. Floating structure according to claim 22, characterized in that it consists of a methane carrier.

* * * * *